US005578779A

United States Patent [19]

Peers, Jr.

[11] Patent Number: 5,578,779

[45] Date of Patent: Nov. 26, 1996

[54] METHOD AND INTEGRATED CIRCUIT FOR ELECTRONIC WAVEFORM GENERATION OF VOICED AUDIO TONES

[75] Inventor: Roi N. Peers, Jr., Livermore, Calif.

[73] Assignee: ESS Technology, Inc., Fremont, Calif.

[21] Appl. No.: 305,087

[22] Filed: Sep. 13, 1994

[51] Int. Cl.[6] ..... G10H 5/00

[52] U.S. Cl. ..... 84/647

[58] Field of Search ..... 84/647, 648, 658–660, 84/663, 625, 675–677, 697, 698

[56] References Cited

U.S. PATENT DOCUMENTS

| | | | |
|---|---|---|---|
| 4,133,241 | 1/1979 | Niimi . | |
| 4,173,164 | 11/1979 | Adachi . | |
| 4,249,447 | 2/1981 | Tomisawa . | |
| 4,253,367 | 3/1981 | Hiyoshi . | |
| 4,297,933 | 11/1981 | Nishimoto . | |
| 4,301,704 | 11/1981 | Nagai . | |
| 4,406,204 | 9/1983 | Katoh . | |
| 4,422,362 | 12/1983 | Chibana . | |
| 4,455,911 | 6/1984 | Yamada . | |
| 4,554,857 | 11/1985 | Nishimoto . | |
| 4,616,546 | 10/1986 | Uchiyama . | |
| 4,643,066 | 2/1987 | Oya . | |
| 4,644,839 | 2/1987 | Nishimoto . | |
| 4,655,115 | 4/1987 | Nishimoto . | |
| 4,747,332 | 5/1988 | Uchiyama . | |
| 4,748,888 | 6/1988 | Oya . | |
| 4,766,795 | 8/1988 | Takeuchi . | |
| 4,788,896 | 12/1988 | Uchiyama . | |
| 4,813,326 | 3/1989 | Hirano . | |
| 4,875,400 | 10/1989 | Okuda et al. | 84/626 |
| 4,942,799 | 7/1990 | Susuki | 84/603 |
| 5,025,702 | 6/1991 | Oya | 84/659 |
| 5,033,352 | 7/1991 | Kellogg | 84/658 |
| 5,076,133 | 11/1991 | Toda | 84/624 |
| 5,094,136 | 3/1992 | Kudo | 84/603 |
| 5,138,924 | 8/1992 | Ohya | 84/604 |
| 5,182,415 | 1/1993 | Kunimoto | 84/660 |
| 5,191,161 | 5/1993 | Oya . | |
| 5,218,156 | 6/1993 | Ilzuka | 84/624 |
| 5,223,653 | 6/1993 | Kunimoto et al. | 84/624 |

*Primary Examiner*—William M. Shoop, Jr.
*Assistant Examiner*—Jeffrey W. Donels
*Attorney, Agent, or Firm*—Law Offices of Thomas E. Schatzel A Prof. Corporation

[57] ABSTRACT

A tone generator clears all registers in a twenty-nine stage device so that the previous results are not used in the calculations for a next tone sample. A series approximation of a desired complex sound waveform is achieved by calculating the contributions of twenty-nine time steps back in time. Twenty-nine different address phases are respectively applied to twenty-nine stacked arithmetic units. Each arithmetic unit comprises a first adder that inputs the output of a previous arithmetic unit and the input of the previous arithmetic unit. A second adder inputs the result from the first adder and one of the twenty-nine address phases. The second adder then reads a waveform generator connected to a multiplier that is controlled by a common multiplication factor "B". The output of the twenty-ninth unit produces the desired tone without any of the stacked units feeding back any signals.

14 Claims, 3 Drawing Sheets

METHOD AND INTEGRATED CIRCUIT FOR ELECTRONIC WAVEFORM GENERATION OF VOICED AUDIO TONES

RELATED APPLICATION

A copending application, Ser. No. 08/305099, filed Sep. 13, 1994, entitled, METHOD AND INTEGRATED CIRCUIT FOR THE FLEXIBLE COMBINATION OF FOUR OPERATORS IN SOUND SYNTHESIS, is incorporated herein by reference.

BACKGROUND OF THE INVENTION

1. Field of the Invention

The present invention relates generally to electronics devices, and more particularly to waveform synthesizers for the generation of voiced musical tones.

2. Description of the Prior Art

Musical instruments each have characteristic voices that relate to the sound amplitude envelope attack rate, decay rate, sustain level and release rate. For example, the envelope of piano sounds has a sharp attack rate when the keys are pressed and then gradually diminishes as the key is held down. By pressing a piano's sustain pedal, the sound will fade away slower. A piano also has a large number of harmonic overtones during the attack. These harmonic overtones decrease over time until a near constant harmonic content results.

Frequency modulation (FM) techniques are conventionally employed in audio sound synthesis digital integrated circuits to generate complex waveforms that contain high harmonic and non harmonic sounds. The correspondence between the modulation index and spectrum distribution of higher harmonics is natural and makes possible a wide range of sound generation. FM sound generation uses effects obtained from modulating a carrier. The pitch, tone and level of a musical sound can be obtained by skillful manipulation of basic FM parameters, e.g., carrier output level, modulator output level, feedback level of the modulator, frequency of the carrier and frequency of the modulator.

John Chowning, U.S. Pat. No. 4,018,121, issued Apr. 19, 1977, describes basic FM synthesis for musical sounds, e.g., a modulating sine wave, a time varying envelope function for the modulating waveform, a carrier sine wave, and a time varying envelope function for the amplitude of the frequency modulated wave. The amplitude of the modulating wave, or the envelope function for the modulating wave, varies with time so that the frequency spectrum of the resulting frequency modulated waveform varies during the attack, sustain, and decay of the sound. It is conventional to use a envelope function to vary the amplitude of the final sound, but Chowning added an envelope function to the modulating waveform to time vary the frequency spectrum of the generated sound.

Music synthesizers commonly use multiple building blocks, "operators", to generate a waveform and execute some function such as amplitude or frequency modulation. The sound of one musical instrument (one channel of the synthesizer) is created by using one or more operators to generate the instrument's characteristic wave shape. Such a wave shape is described as the "tone color" of the instrument. Some instruments can be synthesized more easily than others. The most easily synthesized instruments require only one operator.

Conventional hardware operators are relatively costly. But because the speed of such hardware is relatively very quick compared to the signals they must generate, it is common practice to implement only one or two operators in hardware and then process multiple operators by time division multiplexing within the required sample rate time. The number of perceived operators possible is limited by the sample rate divided by the single hardware operator logic speed, and is therefore fixed for each given synthesizer design.

In general, two operators are required to produce one instrument voice. Each operator consists of a phase modulator and an envelope generator. One operator is typically needed for one percussion sound, although the bass drum sound can require two. A typical synthesizer chip on a card, e.g., the SOUNDBLASTER, has eighteen operators, for a total of eleven voices.

For either FM or AM synthesis, the initial waveform type, e.g. sine wave, triangle wave, square wave, used for either the modulating waveform or the carrier waveform will change the resulting sound. The resulting waveform shape represents what is called the "tone color" or "timbre" perception of the sound. A sine wave is the simplest mathematical waveform input. All other waveforms can be described as being a combination of multiple sine waves. A triangle wave for example can be broken down to a combination of the fundamental sine wave plus a series of the odd harmonics. Each musical instrument sound to be synthesized has its own characteristic waveform shape that can be shown as a combination of sine waves. It is thus desirable in a music synthesizer to have a variety of input waveforms to choose from for generating the sounds in order to match the characteristics of the instrument to be synthesized.

Norio Tomisawa describes, in U.S. Pat. No. 4,249,447, issued Feb. 10, 1981, a method for producing electronic musical instrument tones. Tomisawa discloses an arithmetic unit comprised of an adder and a sinusoid wave memory read by an output "y" of the adder. One input of the adder is connected to an input variable "x" and the other input is connected to an output "sin y" of the sinusoid wave memory after multiplication in a multiplier by a feedback ratio determined by a feedback parameter "β". A product "β sin y" and the variable "x" are therefore input to the adder which produces "x+β sin y", a physical address input for the sinusoidal wave memory. The variable "x" is produced, for example, from circuitry connected to a musical keyboard key. A musical tone is created by passing the output "sin y" through a multiplier connected to an envelope generator. The feedback parameter "β" can be changed to control the tone contents of the tone wave output by the arithmetic unit. The technique of using feedback is therefore critical to the operation of the method and devices described by Tomisawa.

Yamaha LSI, Systems Technology Division (San Jose, Calif.), markets a 24-pin integrated circuit (IC) sound generator under the trademark, OPLII, for FM operator type-LII. This IC has three voicing modes selectable by software control. Nine sound simultaneous voicing, six melody, five rhythm and a speech synthesis mode are all possible. A vibrato oscillator and an amplitude modulation oscillator are also included. The shape of the waveform envelope for music, modulation factor, frequency, voicing, mode and other parameters are determined according to data written to registers within the IC. Such data can be combined to generate the sound of a piano, violin or other musical instrument. A very large number of highly complex combinations can be programmed.

SUMMARY OF THE INVENTION

It is therefore an object of the present invention to provide a tone generator capable of producing a variety of electronic musical instrument voices.

It is a further object of the present invention to provide a tone generator that eliminates the need for a memory for storing feedback tone samples.

Briefly, an embodiment of the present invention clears all registers in a twenty-nine stage device so that the previous results are not used in the calculations for a next tone sample. A series approximation of a desired complex sound waveform is achieved by calculating the contributions of twenty-nine time steps back in time. Twenty-nine different address phases are respectively applied to twenty-nine stacked arithmetic units. Each arithmetic unit comprises a first adder that inputs the output of a previous arithmetic unit and the input of the previous arithmetic unit. A second adder inputs the result from the first adder and one of the twenty-nine address phases. The second adder then reads a waveform generator connected to a multiplier that is controlled by a common multiplication factor "B". The output of the twenty-ninth unit produces the desired tone without any of the stacked units feeding back any signals.

An advantage of the present invention is that a tone generator is provided that generates multiple harmonics needed for good, natural sound quality.

Another advantage of the present invention is that a tone generator is provided that does not require feedback memory by employing instead a feed-forward multiple stage structure.

An advantage of the present invention is that an operator stage is provided that has phase inputs which are readily calculated from the phase input of a previous stage.

An advantage of the present invention is that a tone generator is provided that requires a smaller semiconductor die size due to the elimination of prior art feedback sample memories and advances in process technology.

Another advantage of the present invention is that a tone generator is provided that may be operated as a noise generator, e.g., when beta "B" exceeds one.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
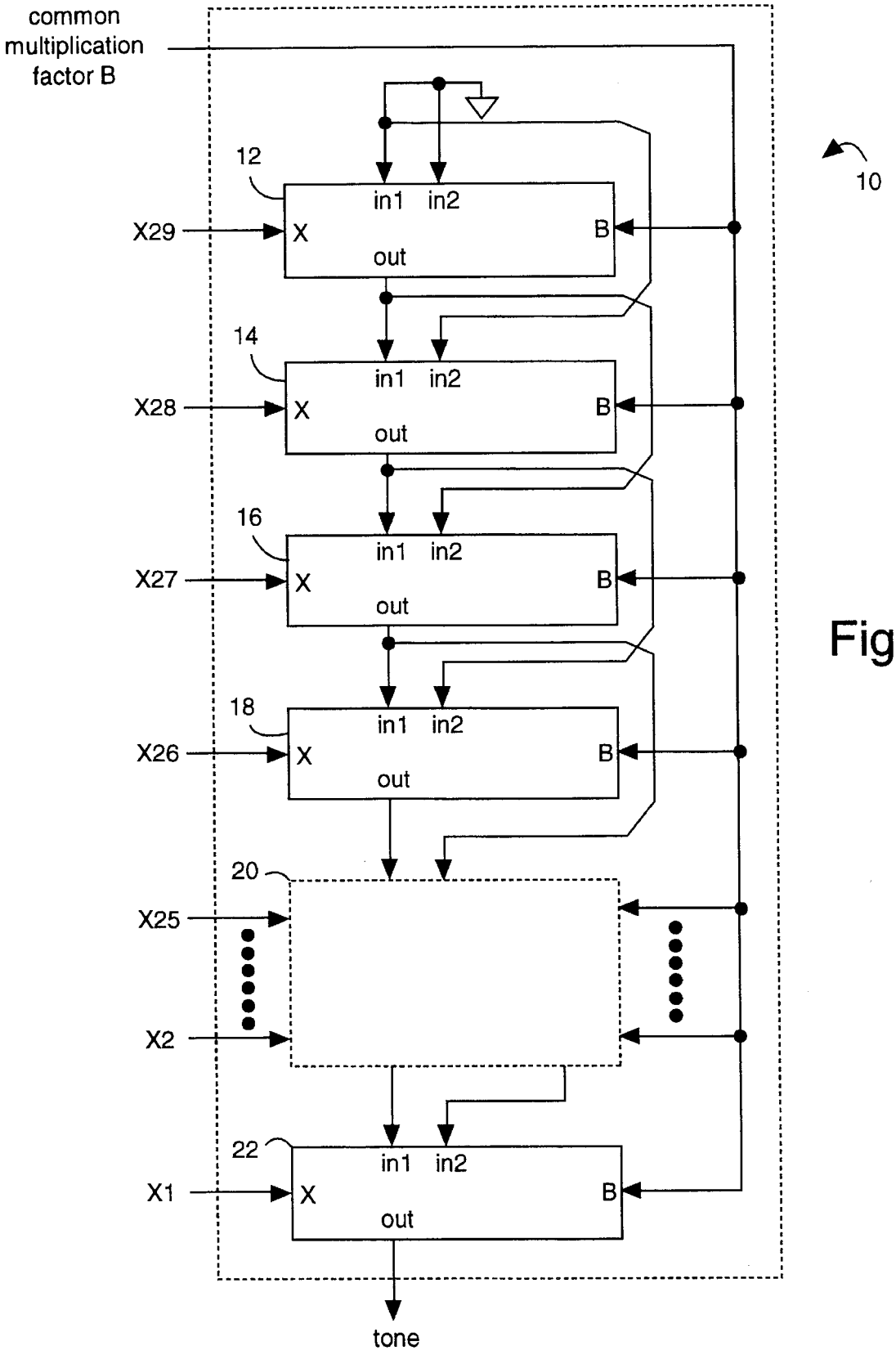
FIG. 1 is a block diagram of a twenty-nine stage tone generator embodiment of the present invention.

FIG. 1 is a block diagram of a twenty-nine stage tone generator embodiment of the present invention, referred to herein by the general reference numeral 10. The tone generator 10 produces complex musical and electronic tones according to signals input to it representing twenty-nine address phases (X1 . . . X29) and a multiplication factor (B). The tone generator 10 comprises a first stage 12, a second stage 14, a third stage 16, a fourth stage 18, a fifth through a twenty-eighth stage represented by block 20 and a twenty-ninth stage 22. Each stage receives a different address phase signal (X1 . . . , X29) and all stages are connected in common to the multiplication factor signal (B). A tone output is available from the twenty-ninth stage 22.

The phase inputs are applied in twenty-nine different phases (X1 . . . X29) with the individual step size in phase between adjacent phases being held constant. The twenty-nine phase address values (X1 . . . X29) are different each stage and vary by the "frequency number", which is the time step that corresponds to the fundamental frequency of the carrier.

Figure 2:
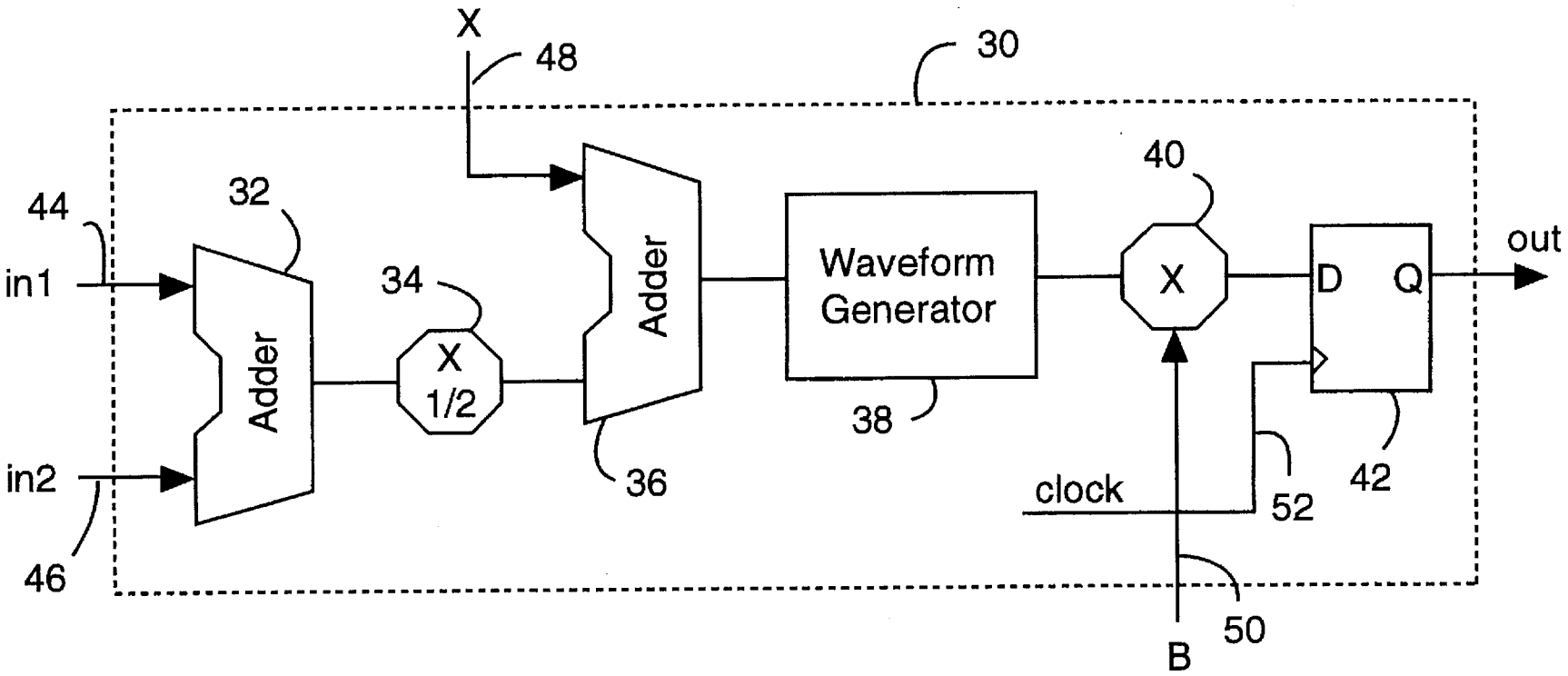
FIG. 2 is a schematic diagram of a typical one of the twenty-nine stages of the tone generator of FIG. 1.

FIG. 2 shows how each of the twenty-nine stages of FIG. 1 are individually configured, as represented by a typical stage 30. The stage 30 comprises a first adder 32 connected to a first multiplier 34, a second adder 36, a waveform generator 38, a second multiplier 40 and a latch 42. A bus 44 receives a digital parallel word representing an input (in1). A bus 46 receives another digital parallel word representing a second input (in2). Each bus 44 and 46 is typically twelve bits wide, although other word widths are just as acceptable. A twelve bit, for example, addition results from operation of the first adder 32 that is multiplied by half by the first multiplier 34. Shifting a digital word one bit toward the least significant bit will effectuate a multiplication by one-half (divide by two). A bus 48 is used to input a digital parallel word representing an address phase to the second adder 36. A digital parallel address is output by operation of the second adder 36 to a waveform generator 38.

A read-only memory (ROM) can be used to implement the waveform generator 38. For example, a whole or a part of a pure sinusoidal waveform may be programmed into the ROM such that an input address "y" results in a digitally represented output value "sin y". Alternatively, the waveform generator may comprise Boolean logic to generate the modulating waveform, and not include any memory at all. It has been found to be practical to implement such a non-memory based waveform generator on an integrated circuit using adders and standard cell gate technology.

The parallel digital output word from the waveform generator 38 is applied to the second multiplier 40. For example, the second multiplier 40 may be implemented with a an adder in the log domain or a shifter that shifts the digital output word from the waveform generator 38, left or right, by a number of bits as controlled by the digital parallel word representing a common multiplication factor (B) on a bus 50. A clock line 52 is common to all twenty-nine stages and causes the calculations performed asynchronously by each stage to be synchronously clocked out through the latch 42 once each period. This arrangement, which is similar to a state-machine, allows the calculated results of a prior stage to settle before being latched, used in the current stage's calculations and then made available to the next subsequent stage on the next clock cycle.

The tone generator 10 is preferably implemented in a single integrated circuit using sub-micron technology, e.g., 0.6 micron technology. The number of stages used in a single tone generator, e.g., the twenty-nine stages used in the tone generator 10, is controlled, in part, by the logic speed realizable in each stage. With 0.6 micron technology, twenty-nine stages was found to be an acceptable number. A particular application may dictate the use of more or less numbers of stages.

Conventional approaches require the feedback of previous tone samples, usually with the aid of a relatively large digital memory that increases die size in an integrated circuit. The present invention calculates each tone sample independent of previous tone samples. The registers are zeroed-out prior to the start of each new calculation. Twenty-nine stages are used to calculate one tone sample, with no bridge to a previous or subsequent tone sample.

Figure 3:
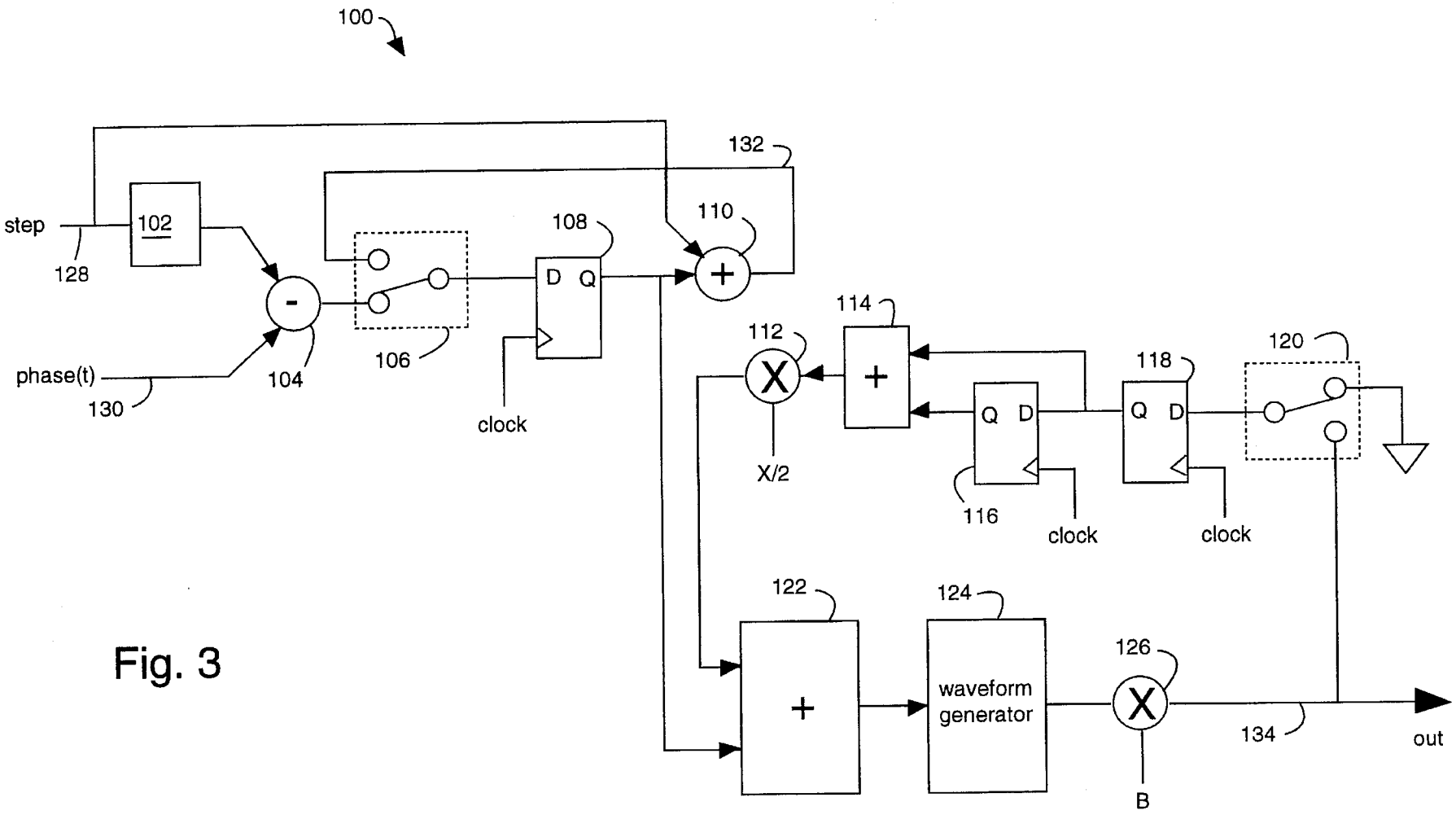
FIG. 3 is a schematic diagram of a reduced hardware implementation of the tone generator of FIG. 1.

FIG. 3 illustrates a circuit 100 which implements the twenty-nine stage tone generator 10 shown in FIGS. 1 and 2. The circuit 100 eliminates duplicating each stage 30 twenty-nine times by reusing a single stage to do twenty-nine calculations in a single tone cycle. In FIG. 1, the first stage has its two inputs, "in1" and "in2", set to zero and uses phase X29 in its computation and the result is fed to the second stage 14. The second stage 14 uses phase X28, one step apart in phase, together with the calculations provided by the first stage 12, and provides its calculated product to the next subsequent stage, and so on until the output is the result of twenty-nine calculations.

The circuit 100 provides the same result by recirculating the digital calculation result from the previous calculation into the current calculation, twenty-nine times, each time using a different step of the phase. The circuit 100 comprises a multiplier 102, a subtractor 104, a switch 106, a latch 108, an adder 110, a multiplier 112, an adder 114, a latch 116, a latch 118, a switch 120, an adder 122, a waveform generator 124 and a multiplier 126. The interconnections between the elements of FIG. 3 while all drawn with single lines represent digital parallel buses, e.g., nineteen bits wide. A bus 128 is used to input the step size increment. A bus 130 is used to input the initial modulation phase. A bus 132 returns the last phase used in a calculation incremented by the step size. The adder 110 provides such an increment. A bus 134 communicates the intermediate calculation results to the switch 120 and the final result for output after the twenty-ninth step.

In operation, the circuit 100 has its two switches 106 and 120, which are set initially as shown in FIG. 3. The first two clock pulses applied to the latches 108, 116 and 118 load the phase(t) from bus 130 minus twenty-eight times the step size from bus 128 into the latch 108 and zeroes into latches 116 and 118. Switches 106 and 120 are both then toggled. Switch 106 then connect the output of the adder 110 to the input of the latch 108. Switch 120 connects the output of the multiplier 126 to the input of the latch 118. The adder 114 is functionally similar to the adder 32 in FIG. 2, with the input "in1" (FIG. 1) coming from the latch 118 and the input "in2" coming from the latch 116. The multiplier 112 is functionally similar to the multiplier 34, with "X/2" representing a control input to multiply by one-half. The adder 122 is functionally similar to the adder 36, where the correct phase input is timely provided by the output of the latch 108. The waveform generator 124 is functionally similar to the waveform generator 38 and may comprise either Boolean logic or a read-only memory (ROM) for generating pure sine waves. The multiplier 126 is functionally similar to the multiplier 40 and is controlled by a signal representing the common multiplication factor "B". For each clock pulse to the latch 108, the adder 110 will add the step size to the last phase output by the latch to the adder 122. This is allowed to continue for twenty-nine steps, where the output is then read from the multiplier 126 and the switches 106 and 120 are toggled to repeat the cycle by loading zeroes into the latches 116 and 118.

Although intermediate calculation results are recirculated through the same arithmetic elements, the recirculation is discrete, step-wise and controlled in number, and therefore not equivalent to feedback. A savings in hardware costs is a principal motivation in time-multiplexing the calculation through the circuit 100. No feedback between tone samples is used. The zeroing-out of latches 116 and 118 every start of every tone sample prevents feedback. The prevention of feedback between tone samples is a critical feature of the present invention.

In general, the present invention uses only one fixed modulating input and one fixed carrier input to each operator. Operators are always assigned to the same channel. Each channel always has the same group of operators. The synthesis of different instruments is accomplished by changing the weights of values applied to the several multipliers of the IC 64, for example.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A stage for generating audio musical tone samples, comprising:

a first adder with a first input for connection to the output of a previous stage, and a second input for connection to the output of a stage previous to said previous stage;

a second adder having a first input connected to an output of the first adder through a multiplier, and a second input for connection to a phase drive distinct in phase from a phase drive applied to said previous stages or a subsequent stage;

a waveform generator connected to receive an address from an output of the second adder and for outputting a waveform as addressed by said address; and a multiplier connected to modify said waveform output by the waveform generator by an input multiplication factor "B" before being output from said stage as a stage output when the present stage is an intermediate stage and as a final tone output when said present stage is a final stage in a chain of stages.

2. The stage of claim 1, further comprising:

a latch connected between the multiplier and said stage output and having a clock input for latching said stage output at the occurrence of a clock pulse common to all stages arranged in said chain of stages, wherein each clock pulse allows a stage calculation to ripple through to a next subsequent stage.

3. A multi-stage device for generating audio musical tone samples, comprising:

a first stage having a pair of daisy-chain inputs connected to ground and a phase input connected to a first phase drive and means for calculating a waveform based signals present on said pair of daisy-chain inputs and first phase input and for outputting said calculation to a first stage output;

at least one intermediate stage in a daisy-chain beginning with the first stage and having a pair of daisy-chain inputs connected one to a stage output of a previous stage and the other one to a second one of said daisy-chain inputs of said previous stage output, and a phase input connected to an intermediate phase drive distinct from said first phase drive, and means for calculating a waveform based signals present on said pair of daisy-chain inputs and said intermediate phase input and for outputting said calculation as an intermediate stage output; and a final stage terminating said daisy-chain of stages beginning with the first stage and having a pair of daisy-chain inputs connected one to a stage output of a previous intermediate stage output and the other one to a second one of said daisy-chain inputs of said previous intermediate stage output, and a phase input connected to an final phase drive distinct from said other phase drives, and means for calculating a waveform based signals present on said pair of daisy-chain inputs and said final phase input and for outputting said calculation to a final tone output.

4. The device of claim 3, wherein each of the first, intermediate and final stages comprise:

a first adder with a first input for connection to the output of a previous stage, and a second input for connection to the output of a stage previous to said previous stage;

a second adder having a first input connected to an output of the first adder through a multiplier, and a second input for connection to a phase drive distinct in phase from a phase drive applied to previous stages or a subsequent stage;

a waveform generator connected to receive an address from an output of the second adder and for outputting a waveform as addressed by said address; and a multiplier connected to modify said waveform output by the waveform generator by an input multiplication factor "B" before being output from said stage as a stage output when the present stage is one of said intermediate stages and as a final tone output when said present stage is said final stage in a chain of stages.

5. The device of claim 4, wherein each stage further comprises:

a latch connected between the multiplier and said stage output and having a clock input for latching said stage output at the occurrence of a clock pulse common to all stages arranged in said chain of stages, wherein each clock pulse allows a stage calculation to ripple through to a next subsequent stage.

6. The device of claim 5, wherein:

there are a total of twenty-nine first, immediate and final stages in said daisy-chain; and said phase drive is a phase address signal calculated by adding a phase step value to the phase address of a previous stage.

7. A recirculating arithmetic circuit for the calculation of musical tone samples from intermediate products feed-forwarded to be included in subsequent intermediate products, comprising:

phase step latching means for an initial loading of a starting phase value and for incrementing a step value by a fixed amount for each of a plurality of intermediate products;

a first adder connected to the phase step latching means for adding said step value to an intermediate feed-forward value;

a waveform generator connected to receive an address value from the first adder and for outputting a waveform representation as addressed by said address value;

a first multiplier connected to modify said waveform output by the waveform generator by an input multiplication factor "B" held constant during each tone sample before being output from said stage as a stage output when the present recirculation is an intermediate recirculation and as a final tone output when said present recirculation is a final one;

latching means for shifting through said output of the first multiplier and a previous cycle output of the multiplier simultaneously to a second adder during an intermediate recirculation and for loading zeros at an initial recirculation to said second adder; and a second multiplier connected to modify an output of said second adder by an input multiplication factor "X" held constant during each tone sample and provided to said first adder as said intermediate feed-forward value.

8. An integrated circuit (IC) for synthesis of musical and electronic tones, comprising:

a first digital adder having a first parallel digital input and a second parallel digital input and an output;

a first digital multiplier having an input connected to said output of the first digital adder and an output;

a second digital adder having a first parallel digital input connected to receive a modulation address phase signal "XN" and a second parallel digital input connected to said output of the first digital multiplier and an output;

waveform generator means having an input connected to said output of the second digital adder and an output for generating a waveform output; and a second digital multiplier having a first digital input connected to said output of the waveform generator means and a control input connected to receive a common multiplication factor "B" and output.

9. The IC of claim 8, further comprising:

a digital latch connected to said output of the second digital multiplier for latching a digital product on the occurrence of a clock pulse.

10. The IC of claim 9, further comprising:

a first digital latch having an input connected to said output of the second digital multiplier for latching a digital product on the occurrence of a clock pulse and having an output connected to said first parallel digital input of the first digital adder; and a second digital latch having an input connected to said output of the first digital latch and an output connected to said second parallel digital input of the first digital adder.

11. The IC of claim 10, further comprising:

initialization means for zeroing said first and second digital latches at the start of a computation cycle; and phase address computational means for inputting discrete stepwise address phases X1 . . . XN to said first parallel digital input of said second adder at said occurrence of said clock pulse.

12. A method of generating complex musical wave forms, comprising the steps of:

digitally adding a first digital input signal to a second digital input signal to produce a first sum in a two-input adder;

digitally multiplying said first sum by a first multiplication factor "x" to produce a first product;

digitally adding said first product to a single digital modulation address phase, in the range X1 . . . XN, to produce a second sum "y" in a two-input adder;

digitally converting said second sum "y" into a function "f(y)" with a waveform generator; and digitally multiplying said function "f(y)" by a common multiplication factor "B" to produce an output product.

13. The method of claim 12, further comprising the subsequent step of:

digitally latching said output product on the occurrence of a clock pulse.

14. The method of claim 12, further comprising the subsequent steps of:

digitally latching said output product on the occurrence of a clock pulse in a first digital latch having a second digital latch cascaded behind the first and providing the respective latched outputs of the first and second digital latches as said first and second digital input signals.

* * * * *